US012687176B2

(12) United States Patent
Azmi et al.

(10) Patent No.: US 12,687,176 B2
(45) Date of Patent: Jul. 21, 2026

(54) BALANCE DRUM FOR A ROTATING MACHINE

(71) Applicant: Saudi Arabian Oil Company, Dhahran (SA)

(72) Inventors: Mutlaq F. Azmi, Tanajib (SA); Naif M. Alghuthayf, Dammam (SA); Mubarak I. Alabdulaaly, Unayzah (SA); Mohammed A. Alswayied, Riyadh (SA); Abdulrahman A. Madani, Jeddah (SA)

(73) Assignee: Saudi Arabian Oil Company, Dhahran (SA)

( * ) Notice: Subject to any disclaimer, the term of this patent is extended or adjusted under 35 U.S.C. 154(b) by 279 days.

(21) Appl. No.: 18/153,001

(22) Filed: Jan. 11, 2023

(65) Prior Publication Data

US 2024/0229828 A1 Jul. 11, 2024

(51) Int. Cl.
*F04D 29/66* (2006.01)

(52) U.S. Cl.
CPC ..... *F04D 29/66* (2013.01); *F04D 29/662* (2013.01); *F04D 29/669* (2013.01)

(58) Field of Classification Search
CPC ..... F04D 29/66; F04D 29/662; F04D 29/669
USPC ..... 415/119
See application file for complete search history.

(56) References Cited

U.S. PATENT DOCUMENTS 2,917,275 A * 12/1959 Magin ..... F01D 17/162 415/105
3,664,758 A 5/1972 Sato
5,615,996 A * 4/1997 Suzuki ..... F04D 29/0416 415/104
7,775,763 B1 8/2010 Johnson et al.
9,279,324 B2 3/2016 Clute et al.
10,584,709 B2 3/2020 Peer et al.
10,816,006 B2 10/2020 Milone et al.
2003/0002977 A1* 1/2003 Camatti ..... F04D 29/0516 415/119
2011/0280742 A1 11/2011 Guenard
2015/0240833 A1* 8/2015 Bigi ..... F04D 29/162 415/173.1
2015/0308443 A1* 10/2015 Stalder ..... F04D 29/0516 415/105
2015/0330391 A1* 11/2015 Bergamini ..... F04D 29/426 415/198.1
2016/0195100 A1* 7/2016 Alban ..... F04D 29/051 415/120
2017/0022997 A1* 1/2017 Felix ..... F04D 29/041
2018/0238332 A1* 8/2018 Ripa ..... F04D 29/448
2018/0266428 A1* 9/2018 Milone ..... F16C 33/109
(Continued)

FOREIGN PATENT DOCUMENTS

CN 103953568 A * 7/2014 ..... F04D 29/041
CN 216077695 3/2022
CN 217582560 U * 10/2022 ..... F04D 29/041

*Primary Examiner* — Kurt Philip Liethen
*Assistant Examiner* — Anthony Donald Taylor, Jr.
(74) *Attorney, Agent, or Firm* — Fish & Richardson P.C.

(57) ABSTRACT

A balance drum for a rotating machine includes an outer ring; an inner disk that includes a bore configured to receive a shaft; and a turbine assembly connected between an outer edge of the inner disk and an inner edge of the outer ring, the turbine assembly including a plurality of blades that extend between the outer edge and the inner edge and define a plurality of apertures therebetween.

18 Claims, 4 Drawing Sheets

(56) References Cited

U.S. PATENT DOCUMENTS

| | | | | |
|---|---|---|---|---|
| 2018/0355879 | A1* | 12/2018 | Huber | F04D 29/0416 |
| 2020/0340480 | A1* | 10/2020 | Felix | F04D 13/08 |
| 2022/0018362 | A1* | 1/2022 | Balconi | F04D 29/445 |

* cited by examiner

BALANCE DRUM FOR A ROTATING MACHINE

TECHNICAL FIELD

The present disclosure describes example implementations of a balance drum for a rotating machine.

BACKGROUND

Rotating machines, such as compressors, expanders, pumps, or otherwise, generate internal thrust forces due to the rotation of impellors or blades on a shaft. Often, another components, such as a thrust bearing or balance drum (or both) is mounted on the shaft to generate a counteracting force to the thrust forces generated by the rotating components of the machine.

SUMMARY

In an example implementation, a rotating machine includes a housing that includes a suction inlet and a discharge outlet. The housing defines a volume that includes a flow path configured to transport a working fluid therethrough. The rotating machine further includes a shaft positioned in the volume and configured to couple to a prime mover and receive rotational force from the prime mover; at least one impeller mounted on the shaft and configured to move the working fluid through the flow path based on the rotational force supplied to the shaft by the prime mover; and a balance drum mounted on the shaft. The balance drum includes an outer ring, an inner disk that includes a bore configured to receive the shaft, and a turbine assembly connected between an outer edge of the inner disk and an inner edge of the outer ring. The turbine assembly includes a plurality of blades that extend between the outer edge and the inner edge and define a plurality of apertures therebetween.

In an aspect combinable with the example implementation, the balance drum is configured to generate an axial thrust force based on a differential pressure between a first axial face of the balance drum and a second axial face of the balance drum opposite the first axial face.

In another aspect combinable with any of the previous aspects, the axial thrust force is opposite a rotor thrust force generated by the at least one impeller during rotation of the at least one impeller on the shaft.

Another aspect combinable with any of the previous aspects further includes a balance line fluidly coupled between the suction inlet and a portion of the flow path adjacent the second axial face of the balance drum.

In another aspect combinable with any of the previous aspects, the balance drum is configured to conserve an amount of fluid power based on flow of the working fluid through the turbine assembly.

In another aspect combinable with any of the previous aspects, the conserved amount of fluid power is defined by:

$$P = \gamma * Q * \frac{(P_d - P_s) * 2.31}{550 * SG} * \eta_t,$$

where P is the conserved amount of fluid power, $\gamma$ is a specific weight of the working fluid, Q is a volumetric flow rate of the working fluid, $P_d$ is a pressure of the working fluid at the discharge outlet, $P_s$ is a pressure of the working fluid at the suction inlet, $\eta_t$ is an efficiency of the turbine assembly, and SG is a specific gravity of the working fluid.

In another aspect combinable with any of the previous aspects, the plurality of blades include a plurality of airfoil blades.

In another aspect combinable with any of the previous aspects, the working fluid includes at least one of a hydrocarbon fluid, a gas, or a liquid.

In another example implementation, a method includes operating a rotating machine that includes a housing that includes a suction inlet and a discharge outlet, the housing defining a volume that includes a flow path; a shaft positioned in the volume and coupled to a prime mover; at least one impeller mounted on the shaft; and a balance drum mounted on the shaft, the balance drum including: an outer ring, an inner disk that includes a bore that receives the shaft, and a turbine assembly connected between an outer edge of the inner disk and an inner edge of the outer ring, where the turbine assembly includes a plurality of blades that extend between the outer edge and the inner edge and define a plurality of apertures therebetween. The method further includes transporting a working fluid through the suction inlet and into the flow path; transporting the working fluid through the flow path with the at least one impeller based on a rotational force supplied to the shaft by the prime mover; transporting at least a portion of the working fluid through the plurality of apertures of the turbine assembly; and transporting the portion of the working fluid from the turbine assembly and to one of the suction inlet or the discharge outlet.

An aspect combinable with the example implementation further includes generating, with the balance drum, an axial thrust force based on a differential pressure between a first axial face of the balance drum and a second axial face of the balance drum opposite the first axial face caused by transport of the working fluid through the plurality of apertures of the turbine assembly.

In another aspect combinable with any of the previous aspects, the axial thrust force is opposite a rotor thrust force generated by the at least one impeller during rotation of the at least one impeller on the shaft.

Another aspect combinable with any of the previous aspects further includes transporting the portion of the working fluid from the turbine assembly to the suction inlet through a balance line fluidly coupled between the suction inlet and a portion of the flow path adjacent the second axial face of the balance drum.

Another aspect combinable with any of the previous aspects further includes conserving an amount of fluid power based on the transporting of the working fluid through the plurality of apertures of the turbine assembly.

In another aspect combinable with any of the previous aspects, the conserved amount of fluid power is defined by:

$$P = \gamma * Q * \frac{(P_d - P_s) * 2.31}{550 * SG} * \eta_t,$$

where P is the conserved amount of fluid power, $\gamma$ is a specific weight of the working fluid, Q is a volumetric flow rate of the working fluid, $P_d$ is a pressure of the working fluid at the discharge outlet, $P_s$ is a pressure of the working fluid at the suction inlet, $\eta_t$ is an efficiency of the turbine assembly, and SG is a specific gravity of the working fluid.

In another aspect combinable with any of the previous aspects, the plurality of blades include a plurality of airfoil blades.

In another aspect combinable with any of the previous aspects, the working fluid includes at least one of a hydrocarbon fluid, a gas, or a liquid.

In another example implementation, a balance drum for a rotating machine includes an outer ring; an inner disk that includes a bore configured to receive a shaft; and a turbine assembly connected between an outer edge of the inner disk and an inner edge of the outer ring, the turbine assembly including a plurality of blades that extend between the outer edge and the inner edge and define a plurality of apertures therebetween.

In an aspect combinable with the example implementation, the balance drum is configured to generate an axial thrust force based on a differential pressure between a first axial face of the balance drum and a second axial face of the balance drum opposite the first axial face.

In another aspect combinable with any of the previous aspects, the axial thrust force is opposite a rotor thrust force generated by at least one impeller of a rotating machine on the shaft.

In another aspect combinable with any of the previous aspects, the balance drum is configured to conserve an amount of fluid power based on a flow of a working fluid through the turbine assembly.

In another aspect combinable with any of the previous aspects, the conserved amount of fluid power is defined by:

$$P = \gamma * Q * \frac{(P_d - P_s) * 2.31}{550 * SG} * \eta_t,$$

where P is the conserved amount of fluid power, $\gamma$ is a specific weight of the working fluid, Q is a volumetric flow rate of the working fluid, $P_d$ is a pressure of the working fluid at the discharge outlet, $P_s$ is a pressure of the working fluid at the suction inlet, $\eta_t$ is an efficiency of the turbine assembly, and SG is a specific gravity of the working fluid.

In another aspect combinable with any of the previous aspects, the plurality of blades include a plurality of airfoil blades.

Implementations of a balance drum for a rotating machine according to the present disclosure can include one, some, or all of the following features. For example, a balance drum for a rotating machine according to the present disclosure can reduce power requirements for a rotating machine and recover wasted energy for the rotating machine. As another example, a balance drum for a rotating machine according to the present disclosure can reduce power requirements for a rotating machine by converting pressure differential to mechanical work. As another example, a balance drum for a rotating machine according to the present disclosure can be implemented for high-pressure pumps and compressors where such equipment consumes high amounts of energy, so any conserved energy by the balance drum can represent a considerable power cost saving.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
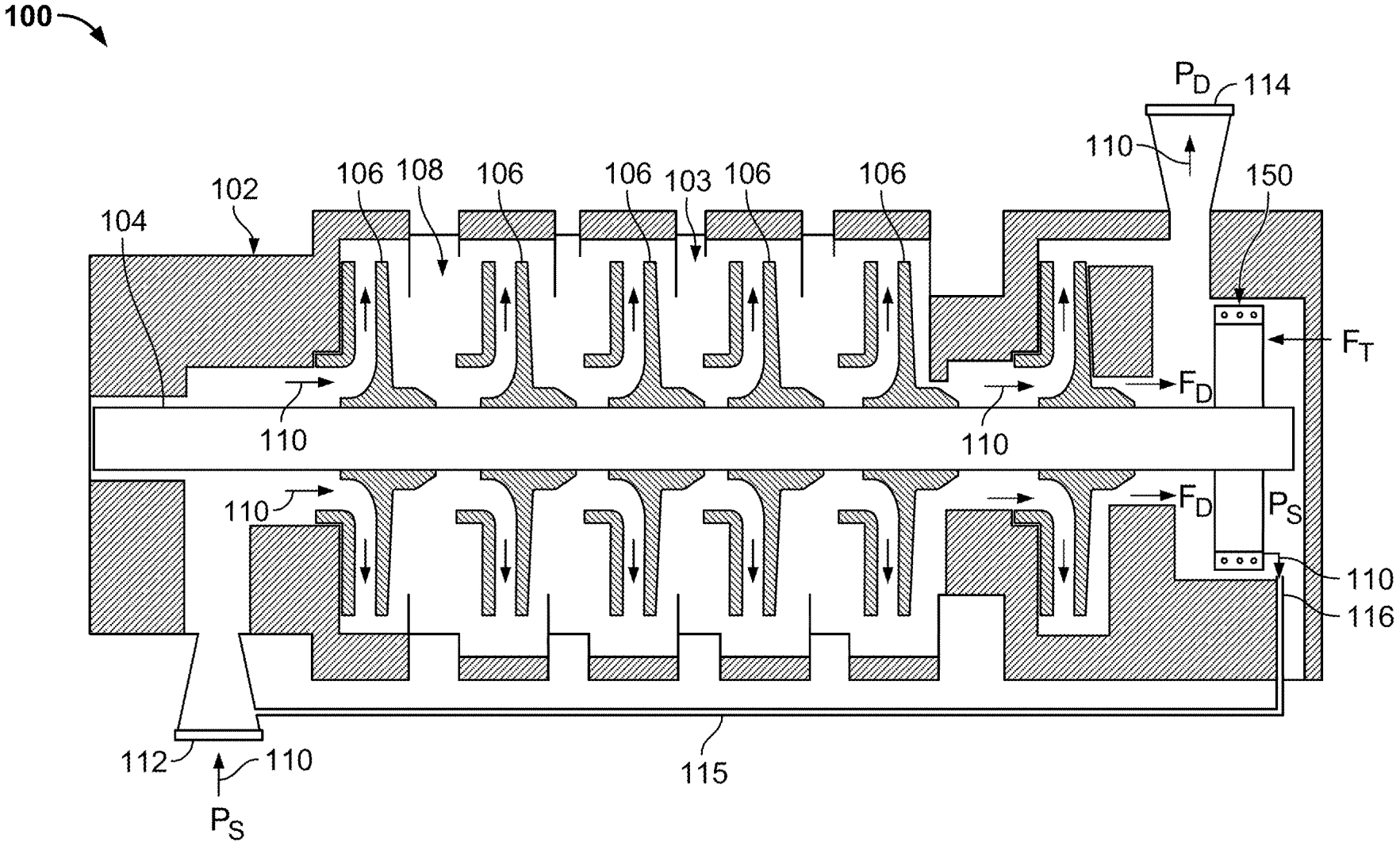
FIG. 1 is a cross-sectional view of at least a portion of a rotating machine that includes a balance drum according to the present disclosure.
Figure 2A:
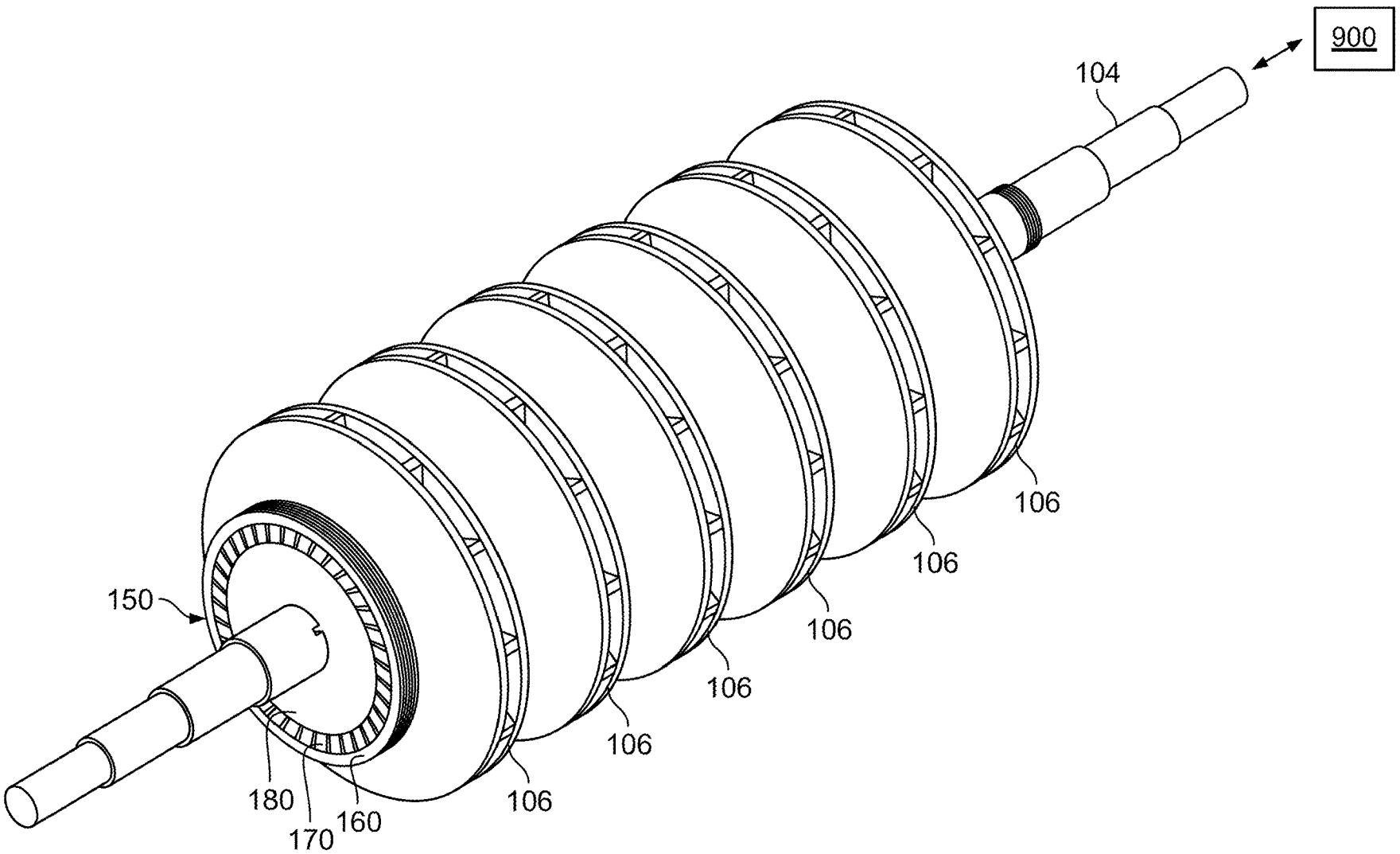
FIG. 2A is an isometric view of at least a portion of a rotating machine that includes a balance drum according to the present disclosure.
Figure 2B:
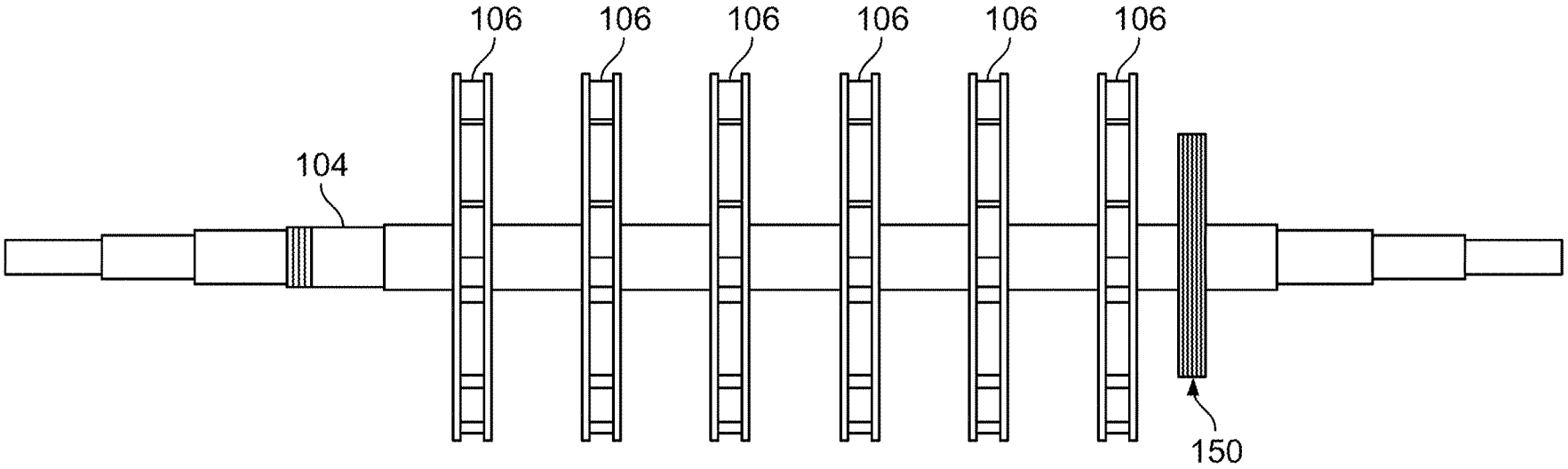
FIG. 2B is a side view of at least a portion of the rotating machine of FIG. 2A that includes a balance drum according to the present disclosure.

FIG. 1 is a cross-sectional view of at least a portion of a rotating machine 100 that includes a balance drum 150 according to the present disclosure. FIG. 2A is an isometric view of at least a portion of the rotating machine 100 that includes the balance drum 150 according to the present disclosure. FIG. 2B is a side view of the portion of the rotating machine 100 of FIG. 2A that includes the balance drum 150 according to the present disclosure. Rotating machine 100, in some aspects, comprises a pump, or compressor, or turbine, in which a working fluid is moved through the machine 100 and enters at a higher pressure than which it leaves the machine 100. As shown, the rotating machine 100 includes a housing 102 that defines a interior volume 103. The interior volume 103 also defines a flow path 108 in which a working fluid 110 (for example, a gas, liquid, or mixed-phase fluid, which may be a hydrocarbon gas, liquid, or mixed-phase fluid) is transported from a suction inlet 112 to a discharge outlet 114. One or more impellers 106 are mounted on a shaft 104 within the interior volume 103 through which the shaft 104 extends (external from, in some aspects, the housing 102).

Generally, the impellers 106 (six shown in this example, but more or fewer contemplated by the present disclosure) rotate on the shaft 104 to move the working fluid 110 from the suction inlet 112, through the flow path 108, and to the discharge outlet 114. The working fluid 110 enters the suction inlet 112 at a suction pressure, $P_S$, and leaves the discharge outlet 114 at a discharge pressure, $P_D$. In some aspects, such as when the rotating machine 100 is a compressor or pump, $P_D$ is greater than $P_S$. In some aspects, such as when the rotating machine 100 is a turbine, $P_S$ is greater than $P_D$.

As further shown in FIG. 1, a balance line 115 includes an opening 116 that fluidly connects a portion of the interior volume 103 with the suction inlet 112. A portion of the working fluid 110, therefore, can be communicated from the interior volume 103 near the discharge outlet 114 back to the suction inlet 112.

In this example implementation of the rotating machine 100, the balance drum 150 is mounted on the shaft 104 in the interior volume 103 at an end of the shaft 104 near the discharge outlet 114. As the shaft 104 rotates (for example, driven by a prime mover 900 shown in FIG. 2A such as an electric motor or engine, or by a high pressure working fluid 110), the balance drum 150 also rotates to generate a thrust force, FT, in a direction as show in FIG. 1 to counterbalance a drive force, FD, generated by rotation of the impellers 106 on the shaft 104. Generally, rotation of impellers 106 in the rotating machine 100 creates the drive force that urges the shaft 104 in the direction of the drive force (which can cause problems if not counteracted). The thrust force generated by the balance drum 150, as shown, counteracts the drive force to reduce a net, axial force acting on the rotating machine 100 by operation of the impellers 106. By reducing the net, axial force (such as a net force that equals FD-FT), a rotor axial load on the rotating machine 100 is minimized.

Turning specifically to FIG. 2A, the balance drum 150 is shown mounted on the shaft 104 and includes an outer ring 160 and an inner disk 180 between which is positioned a turbine assembly 170. The turbine assembly 170 is configured (as described in more detail herein) to allow working fluid 110 to pass therethrough during operation of the rotating machine 100 (for example, as the working fluid 110 is transported from the suction inlet 112 to the discharge outlet 114. As shown in FIG. 1, the balance drum 150 is subject to the suction pressure, PS, on one side (opposite the impellers 106) and the discharge pressure, PD, on the other side (closest to the impellers 106). This pressure differential across the balance drum 150 creates the thrust force as described.

By allowing the working fluid 110 to pass through the turbine assembly 170, extra useful energy can be generated to reduce an overall power consumption of the rotating machine 100. The working fluid 110, for example, flows through the turbine assembly 170 and strikes turbine blades (shown in FIGS. 3A-3B and 4) of the turbine assembly 170, which absorb thrust forces and conserves energy that results in a lower power requirement to rotate the impellers 106 of the rotating machine 100.

This conserved energy can be quantified by the fluid power equation which is given as:

$$P = \gamma * Q * \frac{(P_d - P_s) * 2.31}{550 * SG} * \eta_t \qquad \text{Eq. 1}$$

In Eq. 1, P is the conserved amount of fluid power, $\gamma$ is a specific weight of the working fluid 110, Q is a volumetric flow rate of the working fluid 110, $P_d$ is a pressure of the working fluid 110 at the discharge outlet 114, $P_s$ is a pressure of the working fluid 110 at the suction inlet 112, and $\eta_t$ is an efficiency of the turbine assembly 170. The efficiency of the turbine assembly 170 can be, for example, between 60-65%. In Eq. 1, SG is the specific gravity of the working fluid 110.

Figure 3B:
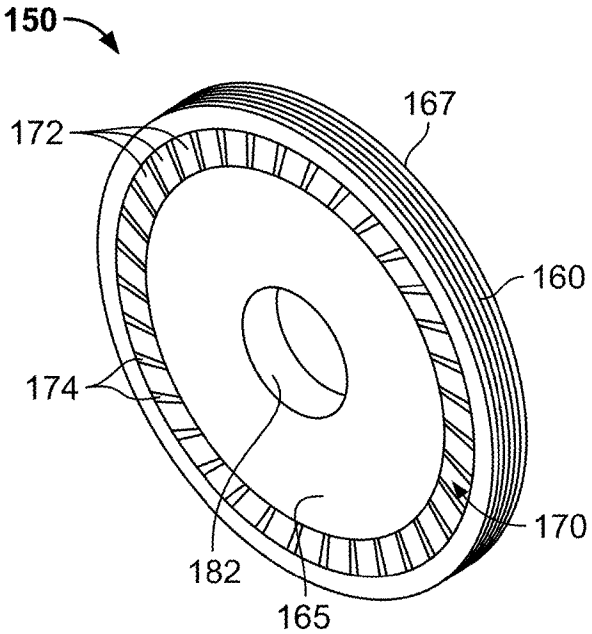
FIGS. 3A and 3B are front and isometric views, respectively, of an example implementation of a balance drum for a rotating machine according to the present disclosure.
Figure 3A:
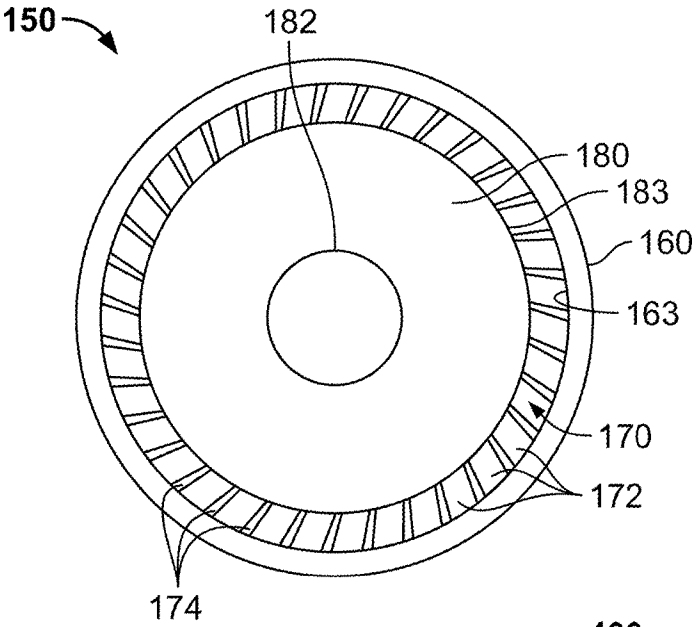

Turning now to FIGS. 3A and 3B, these figures illustrate front and isometric views, respectively, of an example implementation of the balance drum 150 for a rotating machine according to the present disclosure. For example, as shown, the balance drum 150 includes a bore 182 formed through the inner disk 180 to receive the shaft 104. The turbine assembly 170 is positioned between an inner radial surface 163 of the outer ring 160 and an outer radial surface 183 of the inner disk 180. The turbine assembly 170 includes turbine blades 172 that define apertures 174 therebetween through which the working fluid 110 may pass from a first side 165 of the balance drum 150 to a second side 167 of the balance drum 150. As shown in FIGS. 3A-3B, the turbine blades 172 can be airfoil-shaped blades, with a particular curvature.

Figure 4:
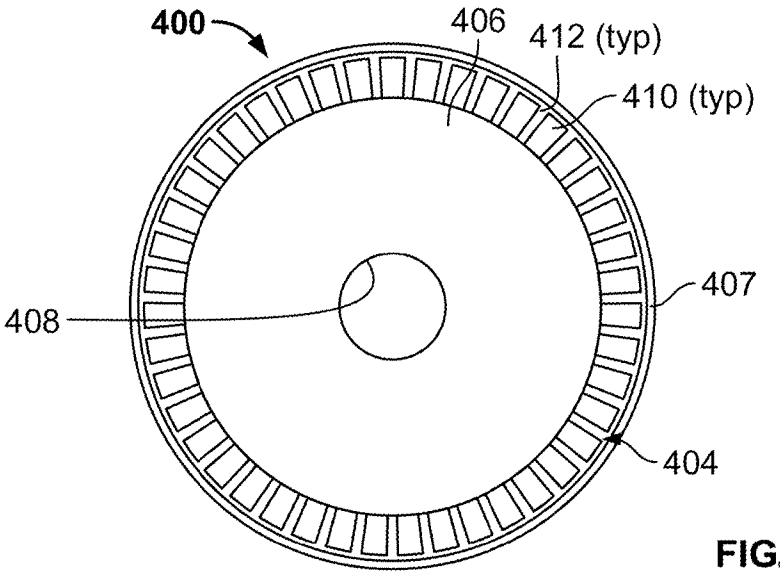
FIG. 4 is a front view of another example implementation of a balance drum for a rotating machine according to the present disclosure.

FIG. 4 is a front view of another example implementation of a balance drum 400 for a rotating machine (such as rotating machine 100) according to the present disclosure. Balance drum 400 includes an inner disk 406 that includes bore 408 (to fit over a shaft), an outer ring 402, and a turbine assembly 404 mounted radially between the inner disk 406 and the outer ring 402. Balance drum 400, in some aspects, can be an alternate configuration to balance drum 300, as the turbine assembly 404 includes straight (not airfoil) turbine blades 412 that define apertures 410 therebetween. A working fluid can pass through the apertures 410 during rotation of the balance drum 400 on the shaft, thereby generating a thrust force to counteract a drive force created by a rotating machine, as well as conserve energy for the rotating machine as described herein.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A rotating machine, comprising:

a housing that comprises a suction inlet and a discharge outlet, the housing defining a volume that comprises a flow path configured to transport a working fluid therethrough;

a shaft positioned in the volume and configured to couple to a prime mover and receive rotational force from the prime mover;

at least one impeller mounted on the shaft and configured to move the working fluid through the flow path based on the rotational force supplied to the shaft from the prime mover; and a balance drum mounted on the shaft and configured to rotate with the shaft based on the rotational force supplied to the shaft from the prime mover, the balance drum comprising:

an outer ring, an inner disk that comprises a bore configured to receive the shaft, and a turbine assembly connected between an outer edge of the inner disk and an inner edge of the outer ring, the turbine assembly comprising a plurality of blades that extend between the outer edge of the inner disk and the inner edge of the outer ring and define a plurality of apertures therebetween, the balance drum configured to generate an axial thrust force based on a differential pressure between a first axial face of the balance drum and a second axial face of the balance drum opposite the first axial face of the balance drum caused by axially transporting the working fluid through the plurality of apertures of the turbine assembly; and a balance line fluidly coupled between the suction inlet and a portion of the flow path adjacent the second axial face of the balance drum, the balance drum configured to conserve an amount of fluid power based on a flow of the working fluid through the plurality of apertures of the turbine assembly.

2. The rotating machine of claim 1, wherein the axial thrust force is opposite a rotor thrust force generated by the at least one impeller during rotation of the at least one impeller.

3. The rotating machine of claim 1, wherein the conserved amount of fluid power is defined by:

$$P = \gamma * Q * \frac{(P_d - P_s) * 2.31}{550 * SG} * \eta_t,$$

where P is the conserved amount of fluid power, $\gamma$ is a specific weight of the working fluid, Q is a volumetric flow rate of the working fluid, $P_d$ is a pressure of the working fluid at the discharge outlet, $P_s$ is a pressure of the working fluid at the suction inlet, $\eta_t$ is an efficiency of the turbine assembly, and SG is a specific gravity of the working fluid.

4. The rotating machine of claim 1, wherein the plurality of blades comprise a plurality of airfoil blades.

5. The rotating machine of claim 1, wherein the working fluid comprises at least one of a hydrocarbon fluid, a gas, or a liquid.

6. A method, comprising:

operating a rotating machine that comprises:

a housing that comprises a suction inlet and a discharge outlet, the housing defining a volume that comprises a flow path;

a shaft positioned in the volume and coupled to a prime mover;

at least one impeller mounted on the shaft; and a balance drum mounted on the shaft, the balance drum comprising:

an outer ring, an inner disk that comprises a bore that receives the shaft, and a turbine assembly connected between an outer edge of the inner disk and an inner edge of the outer ring, the turbine assembly comprising a plurality of blades that extend between the outer edge of the inner disk and the inner edge of the outer ring and define a plurality of apertures therebetween;

transporting a working fluid through the suction inlet and into the flow path;

transporting the working fluid through the flow path with the at least one impeller based on a rotational force supplied to the shaft from the prime mover;

rotating the at least one impeller and the balance drum with the shaft based on the rotational force supplied to by the shaft from the prime mover;

transporting at least a portion of the working fluid axially through the plurality of apertures of the turbine assembly;

transporting the portion of the working fluid from the turbine assembly to one of the suction inlet or the discharge outlet;

generating, with the balance drum rotating with on the shaft, an axial thrust force based on a differential pressure between a first axial face of the balance drum and a second axial face of the balance drum opposite the first axial face of the balance drum caused by the transporting of the portion of the working fluid axially through the plurality of apertures of the turbine assembly; and conserving an amount of fluid power based on the transporting of the portion of the working fluid axially through the plurality of apertures of the turbine assembly.

7. The method of claim 6, wherein the axial thrust force is opposite a rotor thrust force generated by the at least one impeller during rotation of the at least one impeller.

8. The method of claim 6, further comprising transporting the portion of the working fluid from the turbine assembly to the suction inlet through a balance line fluidly coupled between the suction inlet and a portion of the flow path adjacent the second axial face of the balance drum.

9. The method of claim 6, wherein the conserved amount of fluid power is defined by:

$$P = \gamma * Q * \frac{(P_d - P_s) * 2.31}{550 * SG} * \eta_t,$$

where P is the conserved amount of fluid power, $\gamma$ is a specific weight of the working fluid, Q is a volumetric flow rate of the working fluid, $P_d$ is a pressure of the working fluid at the discharge outlet, $P_s$ is a pressure of the working fluid at the suction inlet, $\eta_t$ is an efficiency of the turbine assembly, and SG is a specific gravity of the working fluid.

10. The method of claim 6, wherein the plurality of blades comprise a plurality of airfoil blades.

11. The method of claim 6, wherein the working fluid comprises at least one of a hydrocarbon fluid, a gas, or a liquid.

12. A balance drum for a rotating machine, the rotating machine comprising a housing that comprises a suction inlet and a discharge outlet, and the balance drum comprising:

an outer ring;

an inner disk that comprises a bore configured to receive a shaft; and a turbine assembly connected between an outer edge of the inner disk and an inner edge of the outer ring, the turbine assembly comprising a plurality of blades that extend between the outer edge of the inner disk and the inner edge of the outer ring and define a plurality of apertures therebetween, wherein the turbine assembly is rotatable with on the shaft in response to a rotational force supplied to the shaft from a prime mover, the balance drum is configured to generate an axial thrust force in response to a differential pressure between a first axial face of the balance drum and a second axial face of the balance drum opposite the first axial face of the balance drum caused by axially transporting of a working fluid through the plurality of apertures of the turbine assembly, and the balance drum is configured to conserve an amount of fluid power based on a flow of the working fluid through the plurality of apertures of the turbine assembly.

13. The balance drum of claim 12, wherein the axial thrust force is opposite a rotor thrust force generated by at least one impeller of the rotating machine.

14. The balance drum of claim 12, wherein the plurality of blades comprise a plurality of straight blades, and an efficiency of the turbine assembly is between 60% and 65%.

15. The balance drum of claim 12, wherein the conserved amount of fluid power is defined by:

$$P = \gamma * Q * \frac{(P_d - P_s) * 2.31}{550 * SG} * \eta_t,$$

where P is the conserved amount of fluid power, $\gamma$ is a specific weight of the working fluid, Q is a volumetric flow rate of the working fluid, $P_d$ is a pressure of the working fluid at the discharge outlet, $P_s$ is a pressure of the working fluid at the suction inlet, $\eta_t$ is an efficiency of the turbine assembly, and SG is a specific gravity of the working fluid.

16. The balance drum of claim 12, wherein the plurality of blades comprise a plurality of airfoil blades.

17. The rotating machine of claim 1, wherein the plurality of blades comprise a plurality of straight blades.

18. The rotating machine of claim 1, wherein the at least one impeller comprises six impellers, and the suction inlet and the discharge outlet are oriented in opposed directions.

* * * * *